United States Patent [19]

Coleman

[11] Patent Number: 4,648,751

[45] Date of Patent: Mar. 10, 1987

[54] METHOD AND APPARATUS FOR ERECTING OFFSHORE PLATFORMS

[75] Inventor: Richard K. Coleman, Newbury Park, Calif.

[73] Assignee: Exxon Production Research Co., Houston, Tex.

[21] Appl. No.: 797,371

[22] Filed: Nov. 12, 1985

[51] Int. Cl.[4] ..... E02B 17/02

[52] U.S. Cl. ..... 405/209; 405/203; 405/227; 114/46

[58] Field of Search ..... 405/203, 204, 209, 211, 405/224, 227; 114/29, 30, 46, 61

[56] References Cited

U.S. PATENT DOCUMENTS

| | | | |
|---|---|---|---|
| 1,079,517 | 11/1913 | Rush | 405/209 |
| 2,675,680 | 4/1954 | Emshwiller | 405/227 |
| 3,727,414 | 4/1973 | Davies | 405/196 |
| 3,977,346 | 8/1976 | Natvig | 405/203 |
| 4,187,038 | 2/1980 | Taylor | 405/204 |
| 4,193,714 | 3/1980 | Gjerde | 405/204 |
| 4,378,178 | 3/1983 | Roach | 405/224 |
| 4,380,406 | 4/1983 | Ayers | 405/206 |
| 4,451,174 | 5/1984 | Wetmore | 405/203 |
| 4,492,270 | 1/1985 | Horton | 166/358 |

*Primary Examiner*—Cornelius J. Husar
*Assistant Examiner*—Kristina I. Hall
*Attorney, Agent, or Firm*—John S. Schneider

[57] ABSTRACT

A method is disclosed for installing an integrated deck on a platform substructure located in a body of water. The deck is supported on jack-up means which, in turn, are mounted on a rigid pontoon raft having a U-shaped configuration. The jack-up means is capable of raising and lowering the deck to and from, respectively, the substructure and for raising the composite platform from one position and lowering it to another position offshore. The U-shaped opening in the raft is oriented so that the jack-up means on the barge straddles the substructure below the deck. Piles may be driven through the base from the raft and from the platform itself when the raft has been removed from the deck once the deck has been installed on the substructure.

8 Claims, 15 Drawing Figures

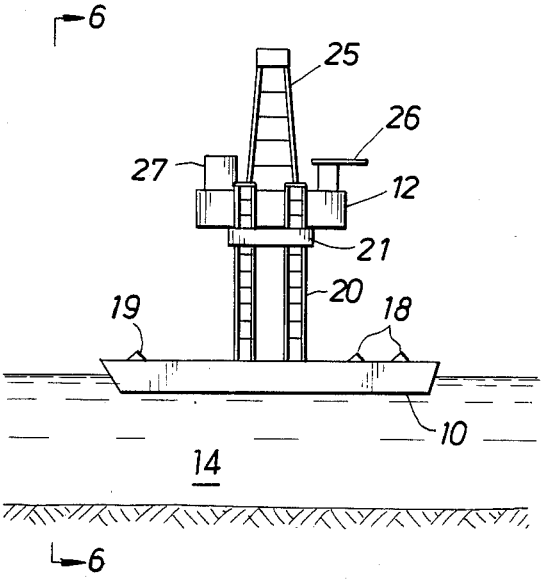
FIG. 5
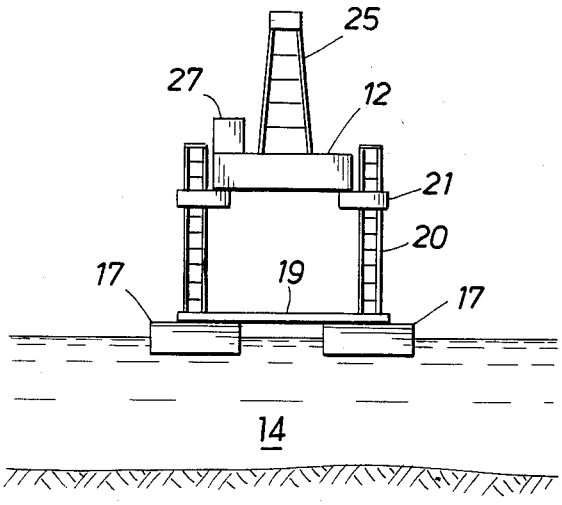
FIG. 6
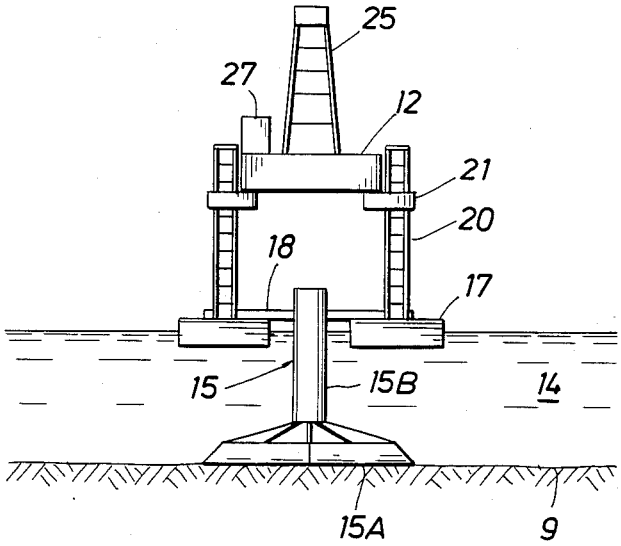
FIG. 7
FIG. 8
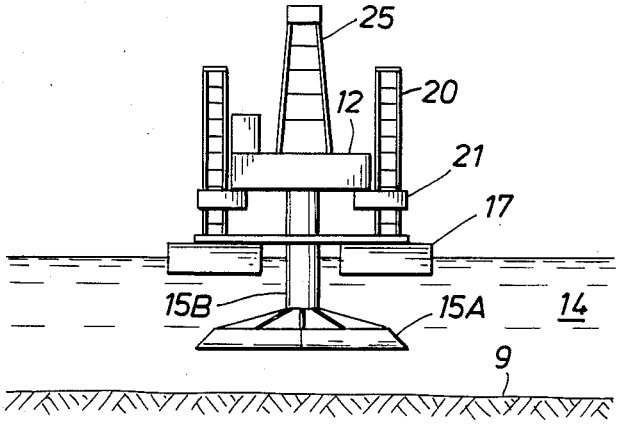

FIG. 12
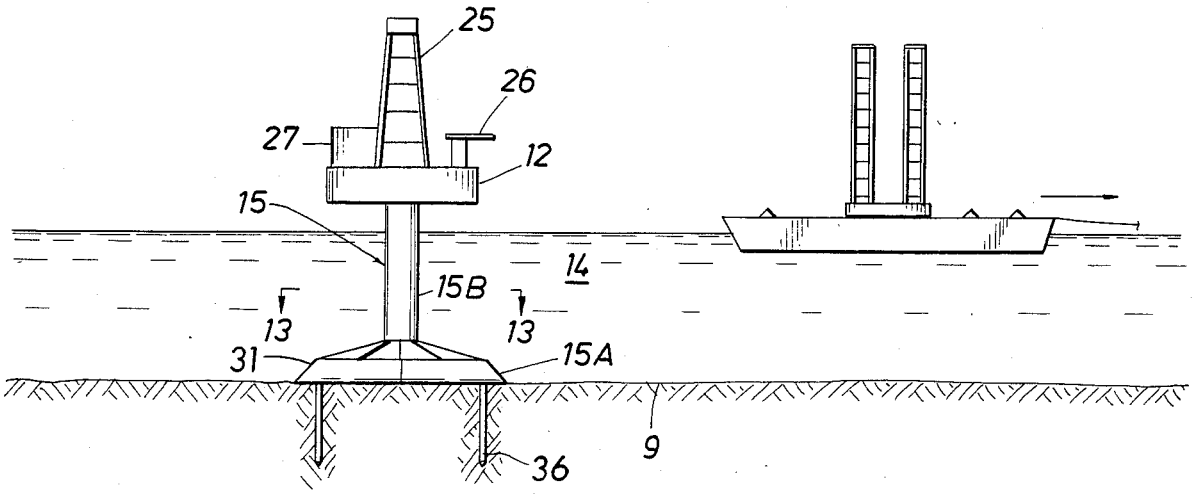
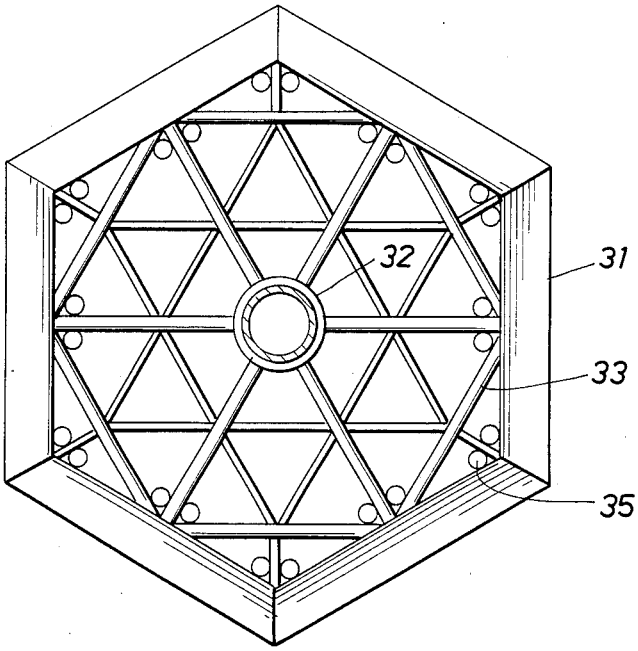
FIG. 13
FIG. 14
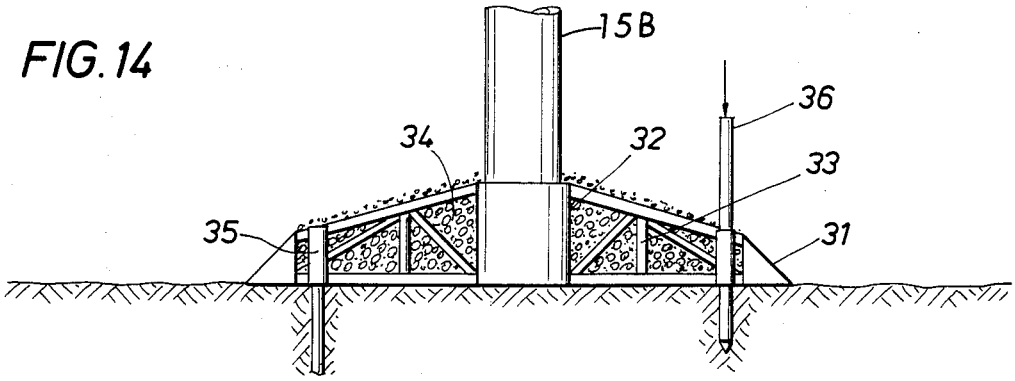

METHOD AND APPARATUS FOR ERECTING OFFSHORE PLATFORMS

BACKGROUND OF THE INVENTION

This invention generally concerns offshore platforms used in drilling for and producing oil and gas. More particularly, the invention concerns the erection of such platforms utilizing integrated decks.

One of the large costs and time delays involved in the installation of conventional offshore platforms results from the extensive offshore work that is required to place a modular deck onto a fixed substructure. Integrated, or single-piece, decks as used on gravity structures have the potential to save considerable time, weight and expense. However, they are difficult or impossible to use on most piled structures that are secured to the sea floor using driven piles. This is particularly true in harsh environments where installation seasons are very short.

PRIOR ART

One concept for installing an integrated deck on an installed substructure involves mounting a deck on a floating barge and, after floating the barge and deck over the substructure, rapidly ballasting the barge to lower the deck onto the substructure. Drawbacks to that concept are: a single barge under the center of the deck tends to make control and stability difficult; the barge must be free to move vertically for mating the deck with the substructure; controlled, rapid lowering of the deck is difficult when relying on rapid ballasting to minimize wave effects; and the procedure is not easily applied to single tower structures—the type structures that are desirable in ice regions.

SUMMARY OF THE INVENTION

A U-shaped barge forms a rigid pantoon raft and is provided with vertical jack-up means capable of supporting an integrated deck and of lowering and raising such integrated deck to and from its position on an offshore substructure. The U-shaped barge and jack-up means are also capable of raising, lowering and transporting the integrated deck alone and with the substructure while they are connected together. The U-shaped barge may be formed of two spaced-apart barges connected together at one of their ends and releasably connected together at their other ends. The width of the U-shaped opening, space or slot between the barges is wider than the width of the substructure. The barge may remain floating at the water surface or, alternatively, below the water surface as a semisubmersible. The support legs of the jack-up means remain above water. The barge is used for transport and there are two deck supports on the support legs but no deck.

The primary difference between the invention and the prior art is in the location of the jacking mechanism used to raise and lower the deck from and onto, respectively, the subsurface structure. The prior art includes many jacking mechanisms used on offshore drilling rigs, each of which requires the jacking mechanism to be part of the platform. The jack-up U-shaped barge offers a reusable jacking system that permits the operator to bring the jacking mechanism back to be used to install additional structures whereas the jacking mechanism in the prior art requires leaving the jacking mechanism in the field on the substructure that uses it.

BRIEF DESCRIPTION OF THE DRAWINGS

FIG. 5 is a schematic side view of the deck being transported on the barges in a raised position;

FIG. 6 is a view along lines 6—6 of FIG. 5;

FIG. 7 is a schematic side view similar to FIG. 6 showing the barges straddling the substructure with the removable strut removed;

FIG. 8 is a schematic view similar to that of FIG. 7 showing the platform being transported after the integrated deck has been connected to the substructure;

FIG. 12 is a schematic illustration of the substructure secured to the ground underlying the water and the barges being towed to another location;

FIG. 13 is a view being taken along lines 13—13 of FIG. 12; and

FIG. 14 is schematic side view of the substructure shown in FIG. 13 after the base has been filled with gravel and secured by piles.

DESCRIPTION OF THE PREFERRED EMBODIMENTS

Figure 1:
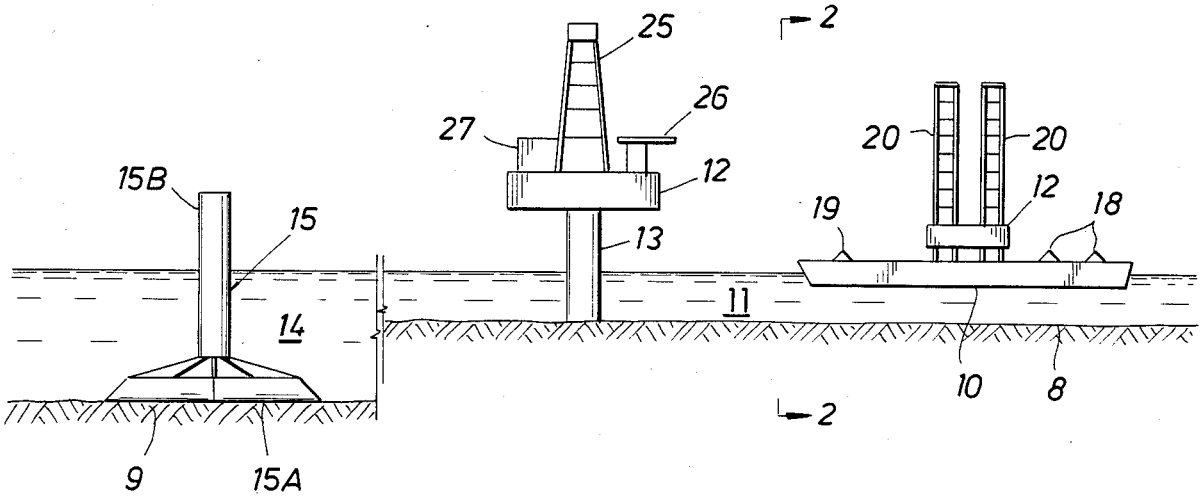
FIG. 1 schematically illustrates three individual components involved in the invention: substructure or base, integrated deck, and mating barges.

The main components of the method and apparatus for installing offshore or marine platforms are shown in FIG. 1. A barge 10 is shown floating in a body of shallow water 11. An integrated deck 12 is positioned on a temporary monopod support column 13 supported on the sea floor 8. In deeper water 14, on the left-hand side of FIG. 1, is shown a substructure 15 for an offshore platform which includes a base 15A and a monopod column 15B mounted on the base arranged on the sea floor 9.

Figure 2:
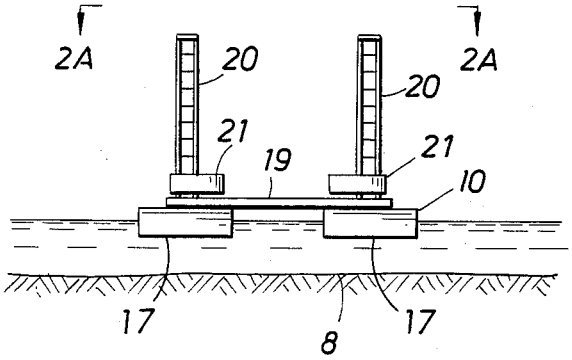
FIG. 2 is an end view of the barges shown in FIG. 1.
Figure 2A:
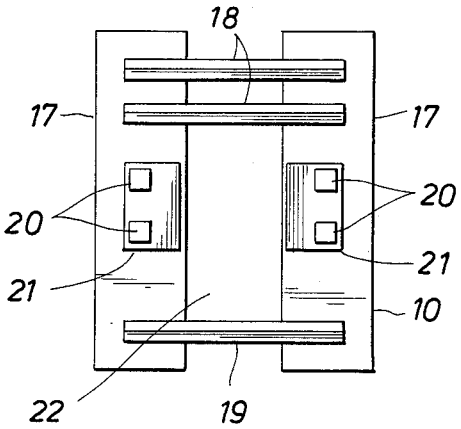
FIG. 2A is a view taken along line 2A—2A of FIG. 2.

As also seen in FIGS. 2 and 2A, barge 10 is formed of two spaced-apart barge hulls 17 connected together by a pair of fixed braces or struts 18 at one end of the hulls and by a pivotal or otherwise removable brace or strut 19 at the other end of the hulls. Two vertical jacking legs, each designated 20, are mounted on each barge hull 17. A jacking frame or cradle 21 is arranged on each pair of jacking legs 20. Integrated deck 12 contains conventional equipment including a drilling derrick 25, a heliport 26 and living quarters 27.

Figure 3:
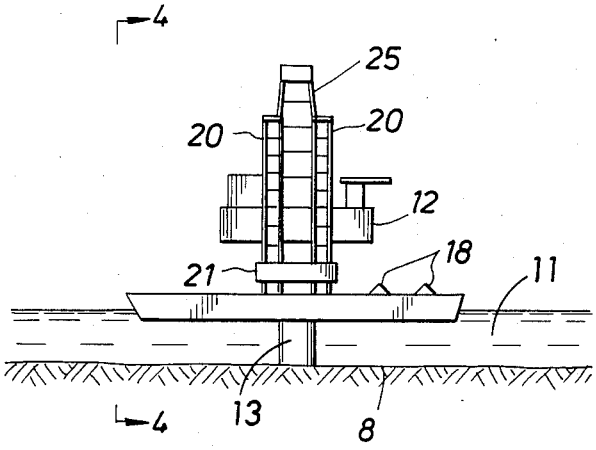
FIG. 3 is a schematic side view of the deck ready to be lifted up by the jacking frames or cradles on the jacking legs.
Figure 4:
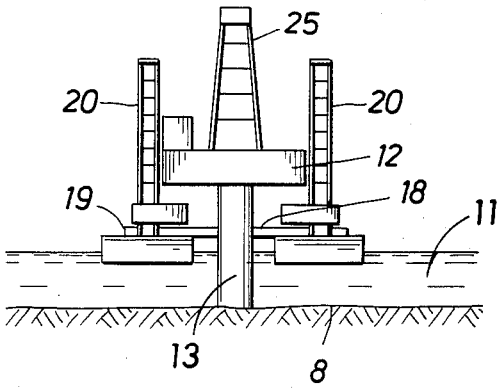
FIG. 4 is view taken on line 4—4 of FIG. 3.

Jack-up barge 10 may be used to move an integrated deck 12 from one location to another location and also to move the deck when connected to substructure 15, i.e., to move the entire platform from one location to another. In FIG. 1, jack-up barge 10 is approaching integrated deck 12 installed on temporary support 13. In FIGS. 3 and 4, jack-up cradles 21 have been floated into position under deck 12 on jack-up barge 10. Brace 19 has been removed and the two hulls 17 are floated into position such that temporary support 13 enters the opening or slot 22 formed between hulls 17. In that position jacking cradles 20 are jacked up on jacking frames or legs 20 to lift deck 12 from temporary support 13 after deck 12 has been disconnected from support 13. Temporary support 13 is built in a convenient, weather protected location to allow more efficient deck fabrication and mating operations. Such supports have proven useful in many applications.

In FIGS. 5 and 6 integrated deck 12 is shown supported on jacking cradles 21 in the raised jacked-up position on jacking legs 20. Brace 19 has been returned to its original position connecting hulls 17 together and barge 10 has been transported to deeper water 14.

In FIG. 7, barge hulls 17 have been maneuvered to position monopod column 15B in slot 22 between the barge hulls. Removable brace 19 has again been removed to permit monopod column 15B to enter slot 22. Integrated deck 12 is then lowered on jacking cradles 21 to the upper end of column 15B. Deck 12 is then attached to column 15B by proven industry techniques. The combined deck 12, monopod column 15B and base 15A are then jacked up using cradles 21 to lift substructure 15 and deck 12 off the sea floor 9. That places deck 12 and monopod column 15B and base 15A in transport position as illustrated in FIG. 8. Brace 19 is returned to its position connecting hulls 17 together.

Figure 9:
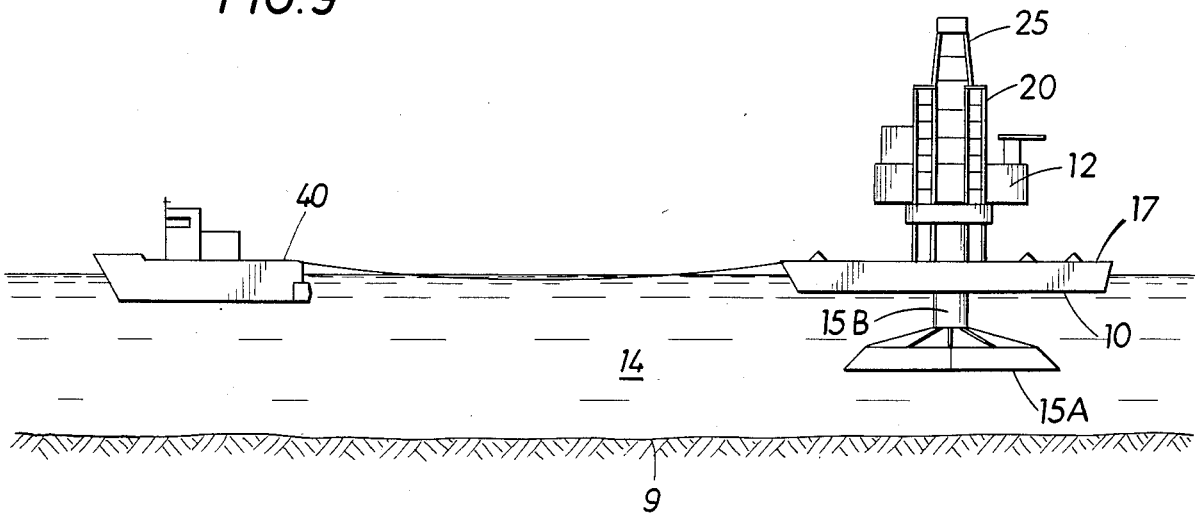
FIG. 9 illustrates schematically towing the barges, on which is supported the integrated deck and substructure, through the water.
Figure 10:
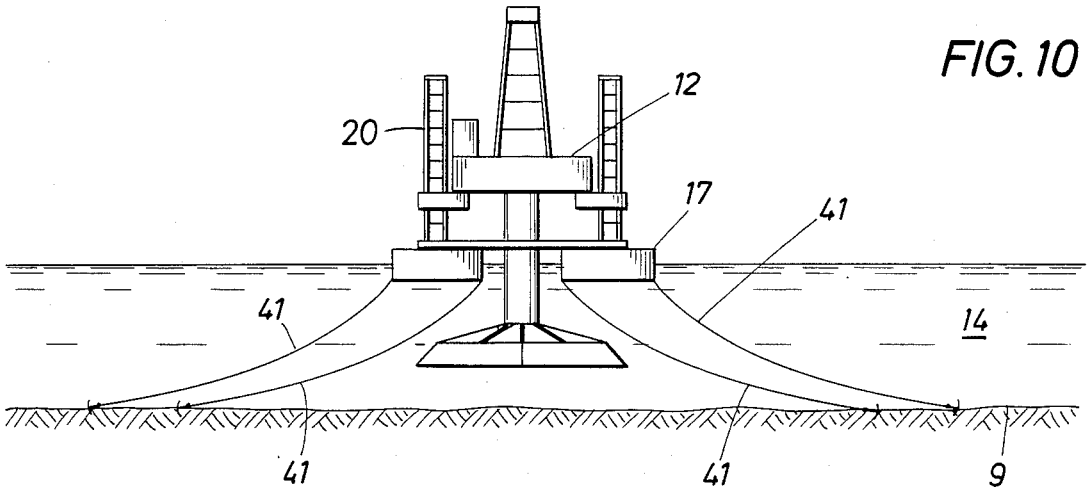
FIG. 10 is a schematic illustration of the barges and integrated deck and substructure shown in FIG. 9 positioned at a desired offshore position.

FIG. 9 shows the composite structure being towed through the body of water 14 by a tug 40. As illustrated in FIG. 10, when the relocation site for the offshore platform is reached, mooring lines 41 are anchored to the sea floor 9 to secure barge hulls 17 over the site. By ballasting the barge hulls and winching, a tight system can be maintained by minimizing barge motions.

Figure 11:
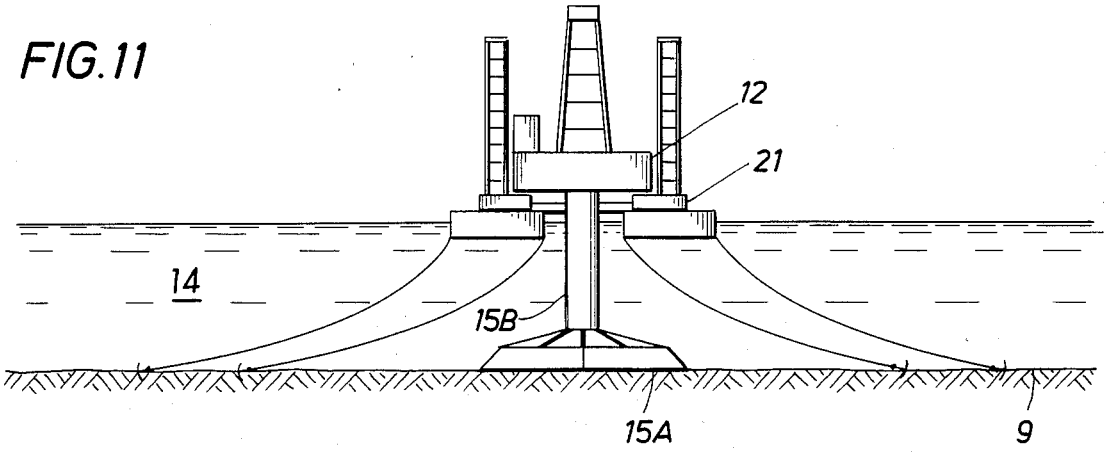
FIG. 11 is a schematic illustration of the substructure in position on the sea floor and the barges in position to be floated from under the integrated deck.

As illustrated in FIG. 11, deck 12 and substructure 15 are then jacked down on jacking cradle 21 until contact of base 15A with the sea floor 9 arrests any further movement.

As seen in FIGS. 12, 13 and 14, hexagonal base ring 31 is connected to a cylindrical sleeve 32 by truss framing 33. Gravel 34 may be packed within base ring 31. A series of pile guides 35 are located within base ring 31 and piles, indicated at 36, are driven through the pile guides.

As illustrated in FIG. 12, barge 10 is towed away. Upon removing barge 10, additional piles are driven for overturning resistance, as indicated in FIGS. 13 and 14, where piles 36 are driven through pile guides 35 positioned in structural base 15A.

As has been shown, mating integrated decks with platform substructures in this manner can be used to lift a deck onto, and remove a deck from, a substructure and, in addition, can be used to install and relocate offshore structures as a single complete platform.

The two large barge hulls form a rigid pontoon raft that has good buoyancy and floating stability. Alternatively, the rigid pontoon raft could be a single large U-shaped barge or a rectangular barge having a U-shaped opening. The only requirement is that the vertical jack-up legs be on the barge such that the integrated deck will fit between them and be supported on the jacking cradles when lowering and raising the deck with or without being connected to the substructure.

There are many beneficial features of this invention. Existing technology is used in carrying out the method. In the preferred embodiment, the two large barges provide excess buoyancy. In that embodiment, there is also freedom to design as much interbarge embracing as desired. The method of the invention is independent of tower or column diameters. Multiple leg structures can be accommodated. Different deck dimensions may be lifted with minor modifications to barge bracing. The two barge hull systems of the preferred embodiment is relatively independent of substructure dimensions. Also, the barge hulls may be reused to spread modification costs over several projects.

Advantages of the installation method of the invention include: the vertical installation allows integrated decks to be installed; the entire structure is capable of being raised for tow through shallow areas; there is space to transport piles and conductors on the same barges; the barges offer great stability during tow; by using equipment on the integrated deck to install piles, the need for an expensive derrick barge is eliminated; removal of the offshore structure is a simple reverse of the installation process; the method is depth limited only by the depth of the towing route and the height capacity of the jack-ups; mating at the final installation site allows deeper structures and mating on pre-installed substructures; and the jacking system can correct for the tides during installation.

Various modifications of the invention described above may be made without departing from the scope of the invention as defined in the appended claims.

I claim:

1. A method of erecting an offshore platform including a deck and marine substructure comprising the steps of:

transporting a deck supported on jack-up legs mounted on a pontoon raft having a U-shaped configuration to a marine platform substructure;

positioning said raft over said substructure;

lowering said deck onto said substructure using said jack-up legs;

attaching said deck to said substructure;

transporting said mated substructure and deck;

lowering said substructure to the sea floor using said jack-up legs; and disconnecting said deck from said jack-up legs.

2. A method as recited in claim 1 in which said pontoon raft comprises two spaced-apart barge hulls connected together by braces, said braces at one of the ends of said barge hulls being removable.

3. A method of erecting an offshore platform including a deck and marine substructure comprising the steps of:

installing a first marine substructure at a selected offshore location;

installing an integrated deck on a temporary second marine substructure at another selected offshore location;

transporting a U-shaped pontoon raft having jack-up cradles arranged on jack-up legs to said second substructure and positioning said U-shaped opening in said raft about said substructure;

disconnecting said deck from said second substructure;

raising said deck on said jack-up cradles on said jack-up legs;

transporting said raft and said deck to said first substructure and positioning said U-shaped opening in said raft about said first substructure;

lowering said deck on said jack-up cradles onto said first substructure;

connecting said deck to said first substructure;

raising said platform by raising said jack-up cradles up to raise said first substructure off the sea floor;

transporting said first substructure and said deck to a selected third location;

lowering said platform by jacking said jack-up cradles down until said first substructure rests on the sea floor;

driving piles through said first substructure into the sea floor;

floating said raft away from said first substructure; and driving additional piles through said first substructure into the sea floor from said deck.

4. A method as recited in claim 3 in which said raft is temporarily anchored to the sea floor when said raft is positioned at said third selected location.

5. Apparatus for erecting an offshore platform used in oil and gas drilling and producing operations, said platform including a substructure extending from the sea floor to above the surface of the water and an integrated deck arranged on the upper end of said substructure comprising:

a U-shaped rigid pontoon raft, said U-shape forming a slot on said raft;

vertical jacking legs mounted on said raft on each side of said slot;

cradles moveable vertically on each jacking leg, said cradles being capable of supporting said deck and of raising and lowering said deck on said cradles from and onto, respectively, the upper end of said substructure and or raising and lowering said platform on said cradles.

6. Apparatus as recited in claim 5 in which said U-shaped raft comprises two spaced-apart barges forming a slot therebetween and connected together at their ends, the connection at one of those ends being releasable.

7. Apparatus as recited in claim 6 in which said substructure comprises a base and a cylindrical column extending from said base to above the surface of the water.

8. Apparatus as recited in claim 7 in which each barge contains two jacking-legs; each pair of jacking-legs supporting a deck elevating cradle.

* * * * *